US005456236A

United States Patent [19]

Wakashiro et al.

[11] Patent Number: 5,456,236

[45] Date of Patent: Oct. 10, 1995

[54] EVAPORATIVE EMISSION CONTROL SYSTEM FOR INTERNAL COMBUSTION ENGINES

[75] Inventors: Teruo Wakashiro; Takeshi Hara; Kouichi Hidano; Kazumi Yamazaki, all of Wako; Tomoyuki Kawakami, Tochigi, all of Japan

[73] Assignee: Honda Giken Kogyo Kabushiki Kaisha, Tokyo, Japan

[21] Appl. No.: 335,373

[22] Filed: Nov. 3, 1994

[30] Foreign Application Priority Data

Nov. 4, 1993 [JP] Japan ..... 5-298931

[51] Int. Cl.[6] ..... F02M 25/08

[52] U.S. Cl. ..... 123/519

[58] Field of Search ..... 123/516, 518, 123/519, 520

[56] References Cited

U.S. PATENT DOCUMENTS

| | | | |
|---|---|---|---|
| 4,308,840 | 1/1982 | Hiramatsu et al. | 123/519 |
| 4,790,283 | 12/1988 | Uranishi et al. | 123/519 |
| 4,817,576 | 4/1989 | Abe et al. | 123/519 |
| 4,894,072 | 1/1990 | Turner et al. | 123/519 |
| 4,915,643 | 8/1990 | Sato et al. | 123/519 |
| 4,919,103 | 4/1990 | Ishiguro et al. | 123/519 |
| 5,056,494 | 10/1991 | Kayanuma | 123/519 |
| 5,111,795 | 5/1992 | Thompson | 123/519 |
| 5,143,041 | 9/1992 | Franzke | 123/516 |
| 5,209,210 | 5/1993 | Ikeda et al. | 123/516 |

FOREIGN PATENT DOCUMENTS 1-159455 6/1989 Japan .

*Primary Examiner*—Thomas N. Moulis

*Attorney, Agent, or Firm*—Nikaido, Marmelstein, Murray & Oram

[57] ABSTRACT

An evaporative emission control system for an internal combustion engine includes a canister for adsorbing evaporative fuel generated in the fuel tank, a first introducing passage for introducing evaporative fuel generated in the fuel tank into the canister on an occasion other than at refueling, a purging passage for purging evaporative fuel adsorbed in the canister into the intake passage of the engine, and a first air-inlet passage communicating between the canister and the atmosphere. First and second adsorbent chambers are formed in the canister and each accommodating an adsorbent. The first introducing passage and the purging passage are connected to the first adsorbent chamber. The first air-inlet passage is connected to the second adsorbent chamber. A communication passage communicates between the first adsorbent chamber and the second adsorbent chamber. A second introducing passage is connected to the first and second adsorbent chambers, for introducing evaporative fuel generated in the fuel tank into the canister at refueling. A second air-inlet passage communicates between the first adsorbent chamber and the atmosphere. An electromagnetic valve is arranged across the second introducing passage, for opening the same at refueling.

12 Claims, 9 Drawing Sheets

EVAPORATIVE EMISSION CONTROL SYSTEM FOR INTERNAL COMBUSTION ENGINES

BACKGROUND OF THE INVENTION

Field of the Invention

This invention relates to an evaporative emission control system for internal combustion engines, which prevents emission of evaporative fuel generated in a fuel tank of the engine into the atmosphere.

Prior Art

An evaporative emission control system of this kind has been proposed, e.g. by Japanese Provisional Patent Publication (Kokai) No. 1-159455, which includes not only an ordinary canister which adsorbs evaporative fuel generated in a fuel tank of the engine during parking of a vehicle in which the engine is installed or during operation of the engine, but also a canister for exclusive use in refueling, which adsorbs evaporative fuel generated during refueling into the fuel tank. According to the proposed evaporative emission control system, to overcome the disadvantage with conventional canisters that they have an insufficient adsorbing efficiency due to a high flow velocity of evaporative fuel generated during refueling, the canister for exclusive use in refueling has a plurality of layers of adsorbents formed of activated carbon defined therein by one or more partitions, wherein the flow path of evaporative fuel is deflected so as to enhance the adsorbing efficiency without increasing the size (ratio L/D(length/diameter)) of the canister.

However, the canister for exclusive use in refueling is not used on occasions other than at refueling, and becomes empty after evaporative fuel adsorbed therein is discharged or purged into the engine. Thus, the utilization factor of the activated carbon is low. Further, two batches of activated carbon have to be provided as adsorbents, one for the canister for exclusive use in refueling, and the other for the ordinary canister, leading to use of a large amount of activated carbon and hence an increased cost. Moreover, at least two purging passages connecting between the respective canisters and the intake passage of the engine have to be provided to discharge evaporative fuel adsorbed in the canisters, resulting in that the evaporative emission control system has a complicated construction.

SUMMARY OF THE INVENTION

It is an object of the invention to provide an evaporative emission control system for internal combustion engines, which is capable of enhancing the utilization factor of adsorbents employed therein and hence curtailing the amount of adsorbents used.

Another object of the invention is to provide an evaporative emission control system for internal combustion engines, which has a simplified construction involving a purging passage connecting between a canister and the intake system of the engine.

To attain the above objects, the present invention provides an evaporative emission control system for an internal combustion engine having an intake passage, and a fuel tank, the system including a canister for adsorbing evaporative fuel generated in the fuel tank, a first introducing passage for introducing the evaporative fuel generated in the fuel tank into the canister on an occasion other than at refueling, a purging passage for purging the evaporative fuel adsorbed in the canister into the intake passage of the engine, and a first open-to-atmosphere passage connected to the canister and communicating with the atmosphere.

The evaporative emission control system according to the invention is characterized by comprising:

- a first adsorbent chamber formed in the canister and accommodating an adsorbent, the first introducing passage and the purging passage being connected to the first adsorbent chamber;
- a second adsorbent chamber formed in the canister and accommodating an adsorbent, the first open-to-atmosphere passage being connected to the second adsorbent chamber;
- a communication passage formed in the canister and communicating between the first adsorbent chamber and the second adsorbent chamber;
- a second introducing passage connected to the first and second adsorbent chambers, for introducing the evaporative fuel generated in the fuel tank into the canister at refueling;
- a second open-to-atmosphere passage connected to the first adsorbent chamber and communicating with the atmosphere; and
- valve means arranged across the second introducing passage, for opening the same at refueling.

The adsorbent accommodated in the first adsorbent chamber and the adsorbent accommodated in the second adsorbent chamber may be of substantially the same kind.

Alternatively, the adsorbent accommodated in the first adsorbent chamber and the adsorbent accommodated in the second adsorbent chamber have different adsorption characteristics from each other.

Advantageously, the evaporative emission control system may further includes heater means for heating the adsorbent accommodated in the first adsorbent chamber.

Also advantageously, the evaporative emission control system includes second valve means arranged across the second air-inlet passage, for opening the same at refueling.

In a preferred embodiment of the invention, the first and second open-to-atmosphere passages have ends thereof connected, respectively, to the second and first adsorbent chambers at one side of the canister, the communication passage being arranged at another side of the canister opposite the one side, the second introducing passage having an end thereof opening into the communication passage.

In another embodiment of the invention, the evaporative emission control system is characterized by comprising:

- a first adsorbent chamber formed in the canister and accommodating an adsorbent, the first introducing passage and the purging passage being connected to the first adsorbent chamber;
- a second adsorbent chamber formed in the canister and accommodating an adsorbent, the first open-to-atmosphere passage being connected to the second adsorbent chamber;
- a third adsorbent chamber formed in the canister and accommodating an adsorbent, the third adsorbent chamber being interposed between the first adsorbent chamber and the second adsorbent chamber;
- a first communication passage formed in the canister and communicating between the second adsorbent chamber and the third adsorbent chamber;
- a second communication passage formed in the canister and communicating between the first adsorbent chamber and the third adsorbent chamber;

a second introducing passage connected to the second and third adsorbent chambers, for introducing the evaporative fuel generated in the fuel tank into the canister at refueling;

a second open-to-atmosphere passage connected to the first adsorbent chamber and communicating with the atmosphere; and valve means arranged across the second introducing passage, for opening the same at refueling.

The above and other objects, features, and advantages of the invention will be more apparent from the following detailed description taken in conjunction with the accompanying drawings.

DETAILED DESCRIPTION

The invention will now be described in detail with reference to the drawings showing preferred embodiments thereof.

Figure 1:
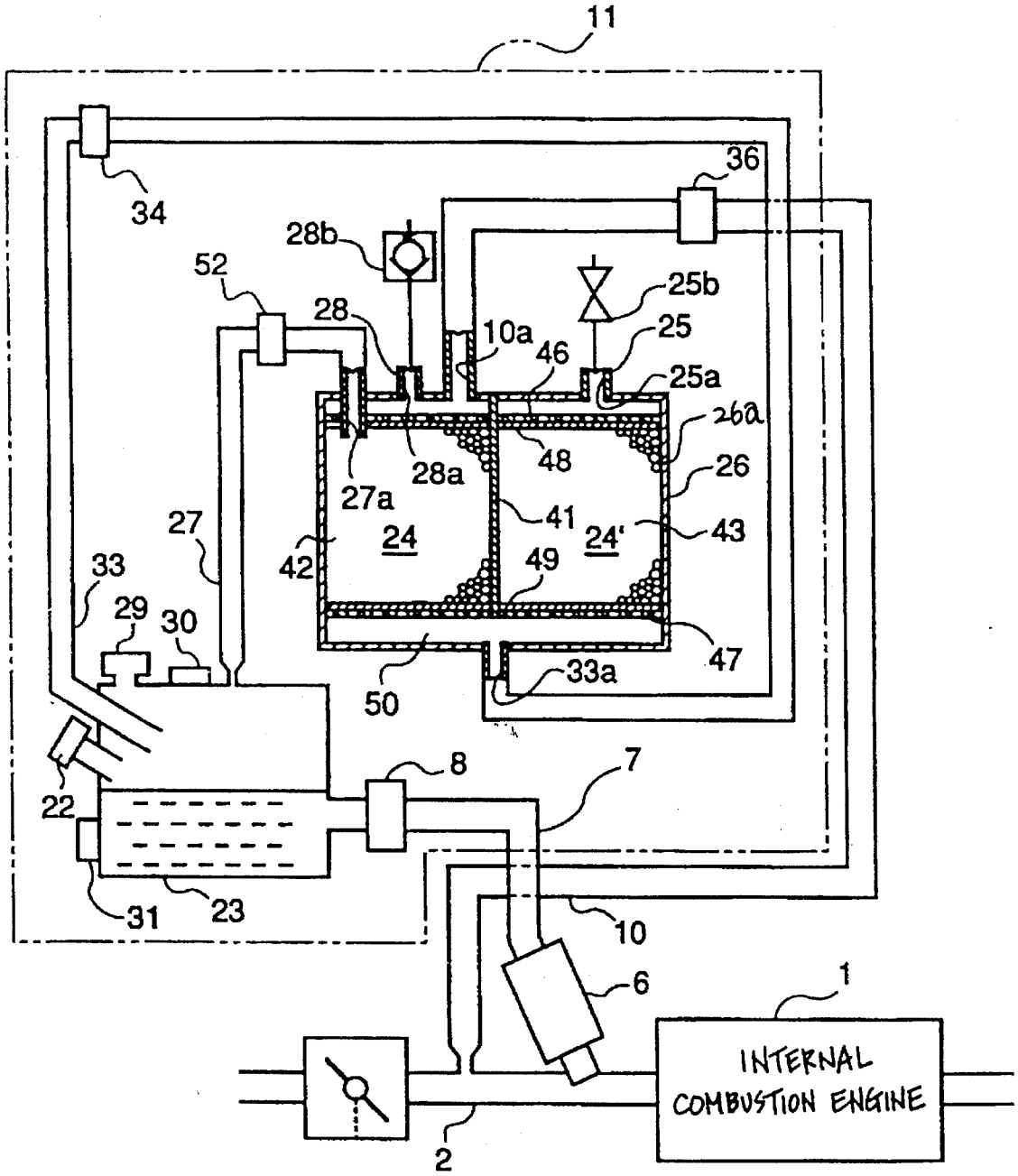
FIG. 1 is a schematic diagram showing the whole arrangement of an evaporative emission control system for an internal combustion engine according to a first embodiment of the invention.

Referring first to FIG. 1, there is illustrated the whole arrangement of an internal combustion engine and an evaporative emission control system therefor, according to a first embodiment of the invention. In the figure, reference numeral 11 designates an evaporative emission control system which operates to prevent emission of evaporative fuel generated in a fuel tank into the atmosphere. The evaporative emission control system 11 is comprised of a fuel tank 23 of an internal combustion engine 1 provided with a filler cap 22 which is opened in refueling, a canister 26 accommodating adsorbents 24 and 24' which are formed of activated carbon, a first charging passage (first introducing passage) 27 for operation on ordinary occasions, connecting between the canister 26 and the fuel tank 23, with an end thereof opening into an upper space within the fuel tank 23, a two-way valve 52 arranged across the first charging passage 27, a second charging passage (second introducing passage) 33 for operation at refueling, connecting between the canister 26 and the fuel tank 23, with an end thereof opening into a space within the fuel tank 23 in the vicinity of the filler cap 22, an electromagnetic valve 34 arranged across the second charging passage 33 for selectively opening and closing the same, a purging passage 10 connecting between the canister 26 and an intake pipe 2 of the engine 1, with an end thereof opening into the intake pipe 2 at a location downstream of a throttle valve 3, and a purge control valve 36 arranged across the purging passage 10 for selectively opening and closing the same. The electromagnetic valve 34 and the purge control valve 36 are controlled by control signals from an electronic control unit (ECU), not shown.

The canister 26 has a first activated carbon chamber (first adsorbent chamber) 42 and a second activated carbon chamber (second adsorbent chamber) 43 formed therein and partitioned from each other by a partition 41. The first and second activated carbon chambers 42, 43 are each defined by a canister casing **26*a*, upper and lower retainer plates 46 and 47, and the partition 41. The upper and lower retainer plates 46, 47 are formed of a porous material and have filters 48 and 49 applied over respective inner side surfaces thereof. The first and second activated carbon chambers 42, 43 are densely charged, respectively, with the adsorbents 24, 24' which are formed of almost the same kind of activated carbon and in almost the same amount as each other. The canister 26 has an inlet port 27*a* for use on ordinary occasions, an air-inlet port 28*a*, and a discharge port 10*a*, which are provided in an upper portion of the canister 26 in or above the first activated carbon chamber 42, and connected, respectively, to the first charging passage 27, an air-inlet passage (second air-inlet passage) 28 communicating with the atmosphere, and the purging passage 10. The inlet port 27*a* for use on ordinary occasions extends through the upper retainer plate 46 and the filter 48 to directly open into the activated carbon adsorbent 24. Further, the canister 26 has an air-inlet port 25*a* provided in an upper portion of the canister 26 above the second activated carbon chamber 43 and opening into a gap defined between the casing 26*a* and the upper retainer plate 46. The air-inlet port 25*a* is connected to an air-inlet passage (first air-inlet passage) 25 communicating with the atmosphere. A gap (communication passage) 50 is defined between the casing 26*a* and the lower retainer plate 47 at a location just below a lower end of the partition 41, and through which the first and second activated carbon chambers 42, 43 are communicated with each other. Another inlet port 33*a* is connected to the canister 26 in a fashion directly opening into the gap 50 at a lengthwise middle point thereof. The port 33*a* is connected to a second charging passage 33 for operation at refueling. A normally-open electromagnetic valve 25*b* and a one-way valve 28*b* are arranged across the first and second air-inlet passages 25, 28** for opening and closing the same, respectively.

Mounted in the intake pipe 2 at locations downstream of an end of the purging passage 10 opening into the intake pipe 2 are fuel injection valves 6 which are connected to the fuel tank 23 through a fuel supply pipe 7 and a fuel pump 8 arranged across the pipe 7. The fuel tank 23 is provided with a tank internal pressure sensor 29 and a fuel amount sensor 30, both mounted in an upper portion of the fuel tank 23 for sensing pressure within the fuel tank 23 and an amount of fuel within the fuel tank 23, respectively, as well as a fuel temperature sensor 31 mounted in a lateral side wall of the fuel tank 23 for sensing the temperature of fuel within the fuel tank 23.

Figure 2:
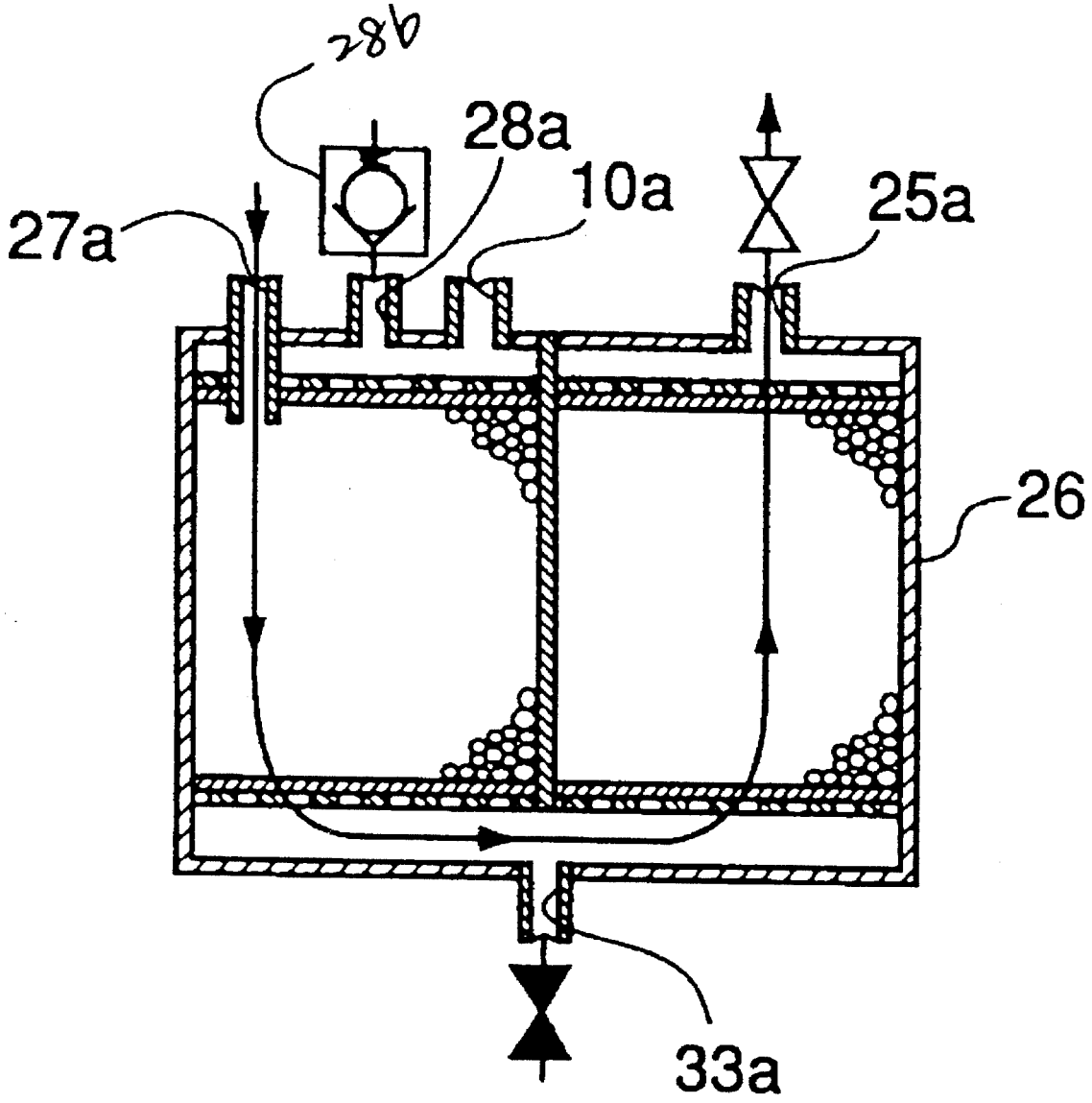
FIG. 2 is a sectional view of a canister appearing in FIG. 1, useful in explaining how there occurs in the canister a flow of evaporative fuel normally generated in a fuel tank, e.g. during parking of a vehicle in which the engine is installed, with the engine in stoppage, or during operation of the engine.

Description will be made as to how evaporative fuel is adsorbed into the canister 26 and purged therefrom in the evaporative emission control system constructed as above. First, during parking of a vehicle in which the engine 1 is installed, with the engine in stoppage, or during operation of the engine, no driving signal from the ECU, not shown, is supplied to the electromagnetic valve 34 to keep the same closed. Then, evaporative fuel generated in the fuel tank 23 is guided through the first charging passage 27 for use on ordinary occasions and the inlet port 27*a* into the first activated carbon chamber 42 within the canister 26. FIG. 2 shows how evaporative fuel generated in the fuel tank 23 flows on an ordinary occasion such as during parking of the vehicle with the engine in stoppage, or during operation of the engine. As shown in the figure, evaporative fuel from the chamber 42 first forcibly opens and passes the two-way valve 52 arranged across he first charging passage 27 to be adsorbed by the activated carbon adsorbent 24 within the first activated carbon chamber 42. Then, an overflow of evaporative fuel from the chamber 42 is guided through the communication passage 50 below the partition 41 into the second activated carbon chamber 43 where it is adsorbed by the activated carbon adsorbent 24'. Since on this occasion no driving signal from the ECU is supplied to the magnetic valve 34 to keep it closed as mentioned before, there occurs no backflow of evaporative fuel from the canister 26 to the fuel tank 23 through the second charging passage 33. Further, on this occasion the one-way valve 28*b* remains closed to close the second air-inlet passage 28*a* so that there positively occurs a serial flow of evaporative fuel through the canister 26. Since evaporative fuel thus flows serially through the first activated carbon chamber 42, the communication passage 50, and the second activated carbon chamber 43 on an ordinary occasion, the substantial size ratio L/D of the canister 26 can be increased, whereby it is prevented that evaporative fuel passes through the canister 26 without being adsorbed thereby.

Figure 3:
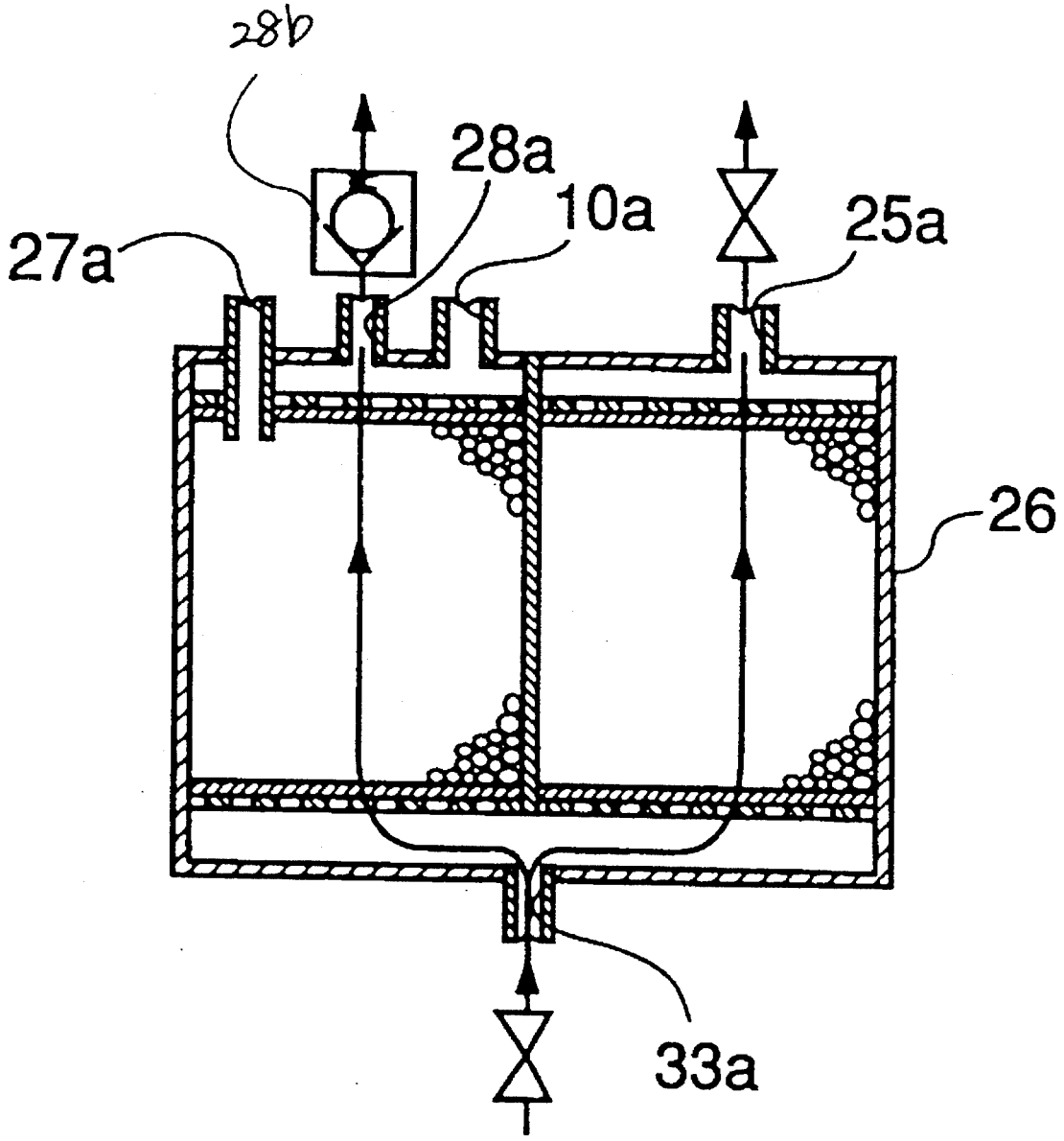
FIG. 3 is a similar view to FIG. 2, useful in explaining how there occurs in the canister a flow of evaporative fuel generated in the fuel tank during refueling.

Next how evaporative fuel generated in the fuel tank 23 at refueling flows will be described with reference to FIG. 3. At refueling, the electromagnetic valve 34 is opened by a driving signal from the ECU. Then, evaporative fuel vigorously generated in large quantities in the fuel tank 23 at refueling is guided through the second charging passage 33 for operation at refueling with an end thereof opening into the fuel tank 23 in the vicinity of the filler cap 22, to the evaporative-fuel introducing port 33*a* at the bottom of the canister 26, wherefrom it is bifurcated into two flows, which enter the first and second activated carbon chambers 42, 43, respectively, to be adsorbed by the respective adsorbents 24, 24'. Overflows of evaporative fuel from the chambers 42, 43 rush toward the respective air-inlet ports 25*a*, 28*a* to be discharged therethrough. On this occasion, increased pressure within the first activated carbon chamber 42 due to vigorously flowing evaporative fuel forces the one-way valve 28*b* to open so that the two flows of evaporative fuel are formed in the canister 26. Thus, at refueling there occur two flows of evaporative fuel running parallel with each other such that the substantial size ratio L/D of the canister 26 can be reduced to thereby decrease the flow resistance and hence prevent increased pressure within the fuel tank 23 which impedes smooth refueling.

Figure 4:
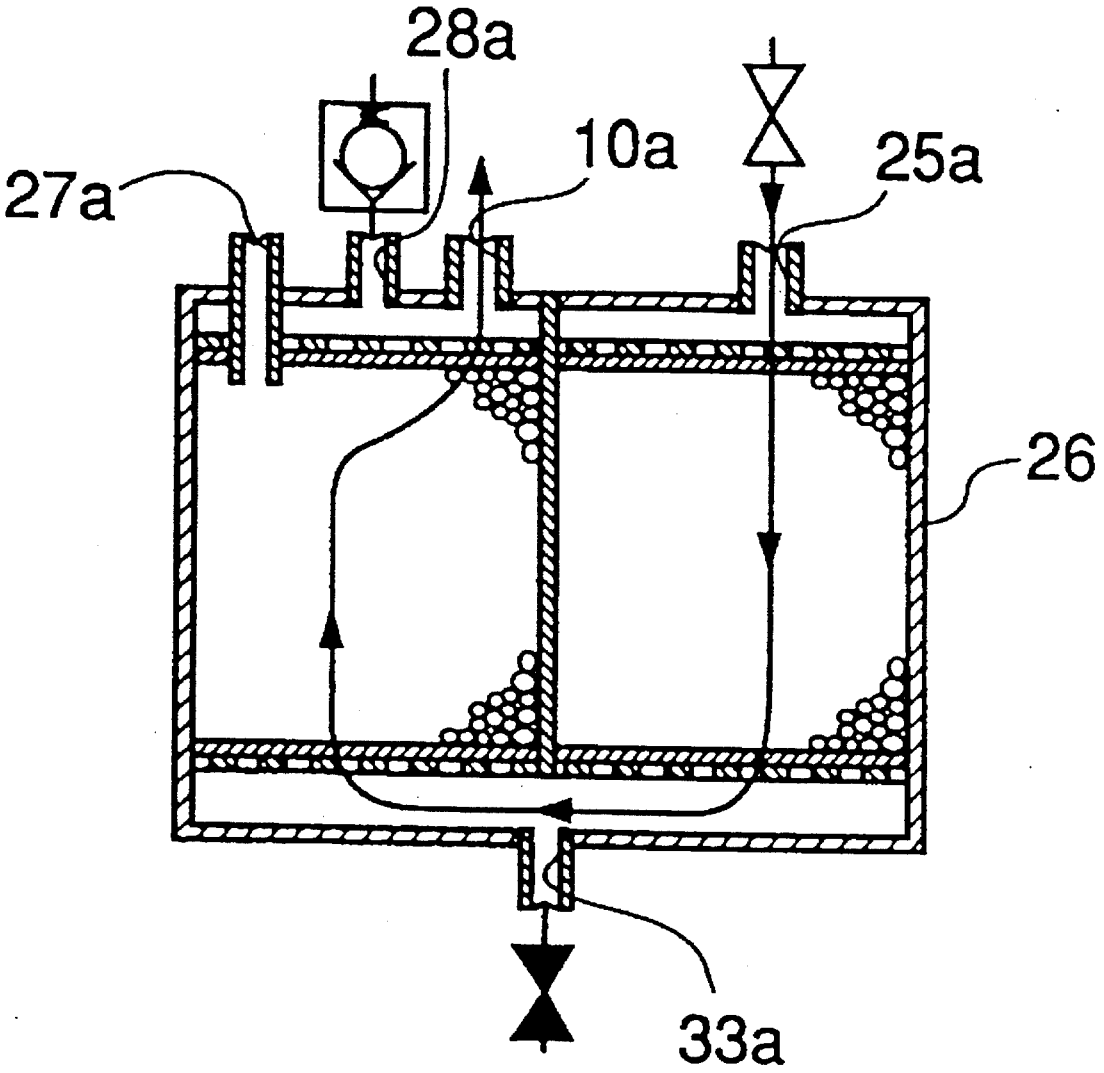
FIG. 4 is a similar view to FIG. 2, useful in explaining how there occurs a flow of evaporative fuel in the canister during purging.

Next, how evaporative fuel is desorbed from the canister 26 and purged into the engine will be described. FIG. 4 shows a flow of evaporative fuel occurring in the canister during purging from the canister 26. To start purging, a driving signal from the ECU is supplied to the purge control valve 36 arranged across the purging passage 10 to open the valve. Purging of evaporative fuel is carried out when the engine 1 is in a predetermined operating condition. When the engine 1 is in such a predetermined operating condition, there is developed vacuum in the intake pipe 2, which is transmitted through the purging passage 10 with the purge control valve 36 being open, into the first activated carbon chamber 42 within the canister 26, and then into the second activated carbon chamber 43 through the communication passage 50. Consequently, fresh air is introduced from the outside into the second activated carbon chamber 43 through the first air-inlet passage 25 and the air-inlet port 25*a*, whereby evaporative fuel is desorbed from the adsorbent 24' due to the flowing-in air, and a mixture of the desorbed evaporative fuel and the air flows through the communication passage 50 into the first activated carbon chamber 42. Then, also evaporative fuel adsorbed by the adsorbent 24 in the first activated carbon chamber 42 is desorbed from the latter, and the resulting mixture of evaporative fuel and air is guided through the purging passage 10 into the intake pipe 2 to be drawn into the engine 1. In this way, evaporative fuel is supplied from the canister 26 to the engine 1 such that evaporative fuel adsorbed by portions of the adsorbents closer to the air-inlet port 25*a* is first supplied to the engine, followed by one adsorbed by portions of the adsorbents remote from the port 25*a* being supplied to the engine.

As described above, according to the present embodiment, both on ordinary occasions and at refueling, evaporative fuel generated in the fuel tank 23 is adsorbed by the activated carbon adsorbents 24, 24' in the first and second activated carbon chambers 42, 43 of the canister 26. As a result, the utilization factor of the adsorbents 24, 24' can be increased. Therefore, as compared with the conventional arrangement wherein activated carbon adsorbents are accommodated in separate canisters for operation, respectively, at refueling and on ordinary occasions, the amount of activated carbon to be used can be curtailed. Further, according to the embodiment, the single purging passage 10 is provided, which simplifies the construction, as compared with the conventional arrangement wherein two or more purging passages are provided. Still further, on an-ordinary occasion the activated carbon adsorbents 24, 24' are substantially arranged in series for a flow of evaporative fuel in the canister 26 to be adsorbed thereby, whereas at refueling they are substantially arranged in parallel with each other for a flow of evaporative fuel in the canister 26 to be adsorbed thereby, whereby passing of evaporative fuel through the canister 26 without being adsorbed therein can be prevented and also refueling can be carried out in a smooth manner.

Figure 5:
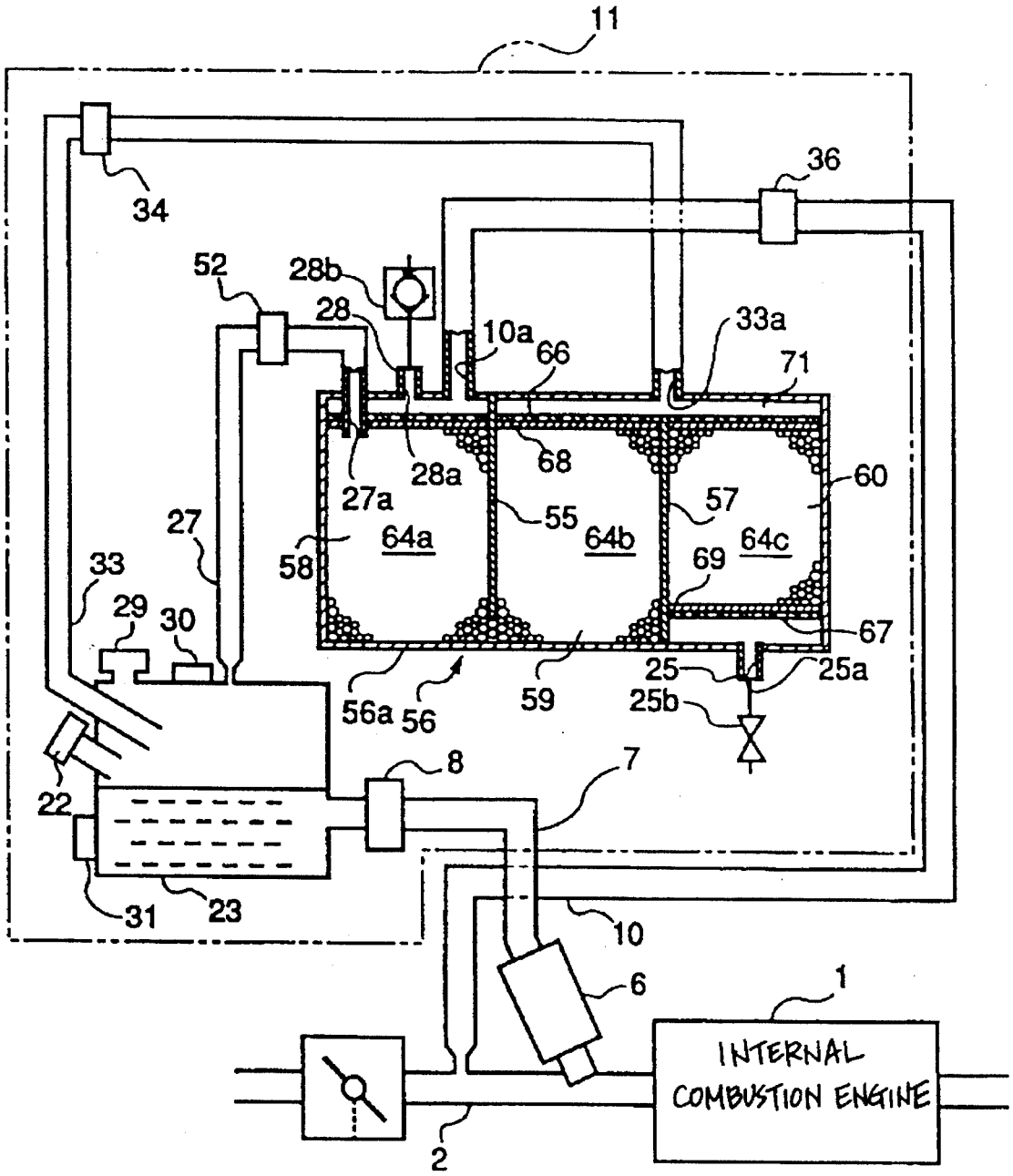
FIG. 5 is a schematic diagram showing the whole arrangement of an evaporative emission control system for internal combustion engine according to a second embodiment of the invention.

Next, a second embodiment of the invention will be described with reference to FIGS. 5–8. Referring to FIG. 5, there is illustrated the whole arrangement of an internal combustion engine and an evaporative emission control system therefor, according to the second embodiment. In FIGS. 5–8, corresponding elements and parts to those in FIGS. 1–4 are designated by identical reference numerals. The evaporative emission control system according to the second embodiment is distinguished from the first embodiment described above only in the construction of the canister, and other elements and parts are substantially identical in arrangement and function with those of the first embodiment. In the second embodiment, a canister 56 is connected to a first charging passage 27 for operation on ordinary occasions, a second charging passage 33 for operation at refueling, the purging passage 10, and first and second air-inlet passages 25, 28, similarly to the first embodiment. The canister 56 has first to third activated carbon chambers 58, 59 and 60 formed therein and partitioned from each other by partitions 55 and 57. The first and second activated carbon chambers 58, 59 are communicated with each other at a lower portion of the canister 56, as hereinafter described and in this sense they can be considered as a single activated carbon chamber. The first, second and third activated carbon chambers 58, 59, 60 are densely charged with adsorbents 64*a*, 64*b*, and 64*c* which are formed of almost the same kind of activated carbon. The first and second activated carbon chambers 58, 59 are communicated with each other through a gap defined between a lower end off the partition 55 and an inner surface of a canister casing 56*a*. An inlet port 27*a* for use on ordinary occasions, a second air-inlet port 28*a*, and a discharge port 10*a* connected, respectively, to a first charging passage 27 for use on ordinary occasions, a second air-inlet passage 28, and a purging passage 10 are provided in an upper portion of the canister 56 in or above the first activated carbon chamber 58. The inlet port 27*a* for use on ordinary occasions extends through an upper retainer plate 66 and a filter 68 to directly open into the activated carbon adsorbent 64*a*. Further, the canister 56 has an air-inlet port 25*a* provided in an upper portion of the canister 56 below the third activated carbon chamber 60 and opening into a gap defined between the casing 56*a* and a lower retainer plate 67. The air-inlet port 25*a* is connected to a second air-inlet passage 25 communicating with the atmosphere. A normally-open electromagnetic valve 25*b* and a one-way valve 28*b* are arranged across the first and second air-inlet passages 25, 28, respectively, for opening and closing the same. A gap (communication passage) 71 is defined between the casing 56*a* an the upper retainer plate 66 at a location above the second and third activated carbon chambers 59, 60, and through which the second and third activated carbon chambers 59, 60 are communicated with each other. Another inlet port 33*a* is connected to the canister 56 in a fashion directly opening into the communication passage 71 at a lengthwise middle point thereof. The port 33*a* is connected to the second charging passage 33 for use at refueling. Fuel injection valves 6 are mounted in an intake pipe 2 of the engine 1 at locations downstream of an end of the purging passage 10 opening into the intake pipe 2 and connected to a fuel tank 23 through a fuel supply pipe 7 and a fuel pump 8 arranged across the pipe 7, similarly to the first embodiment.

Figure 6:
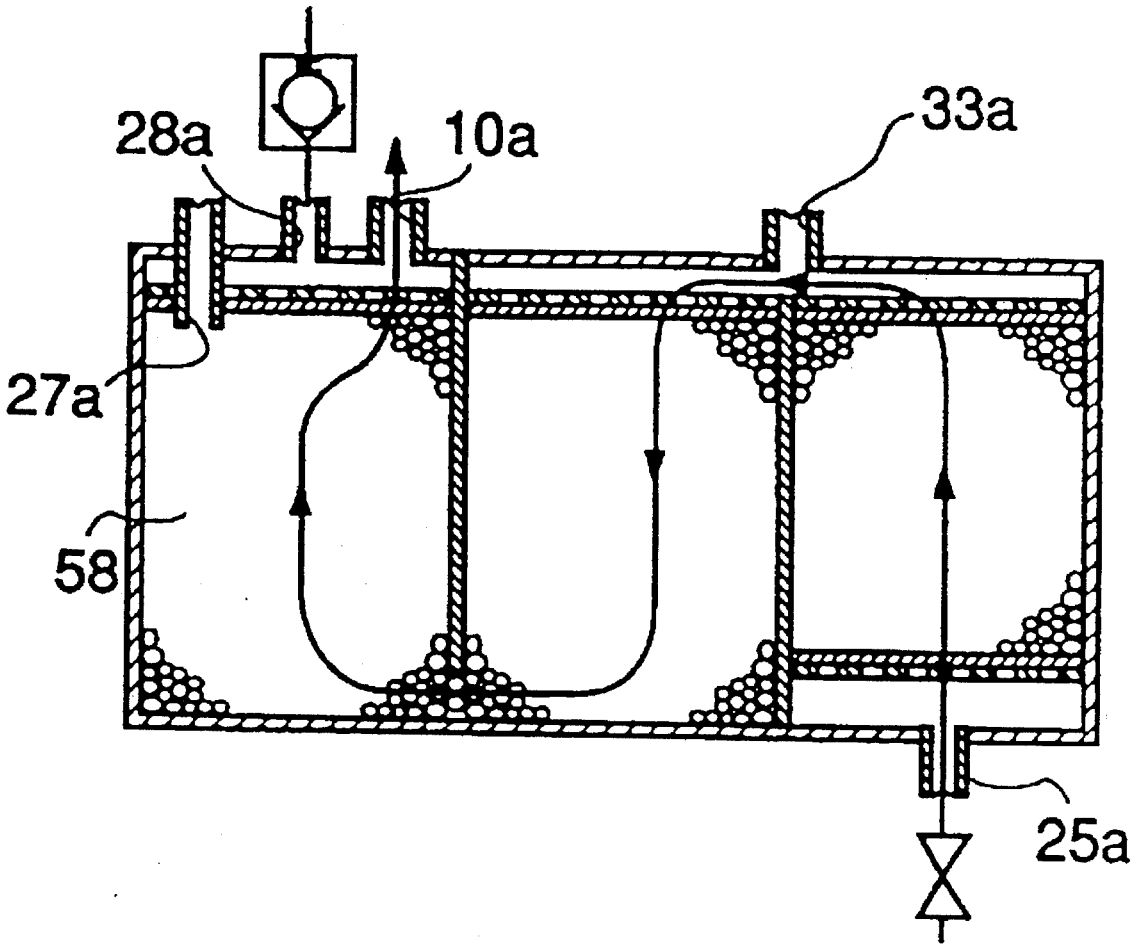
FIG. 6 is a sectional view of a canister appearing in FIG. 5, useful in explaining how there occurs in the canister a flow of evaporative fuel normally generated in a fuel tank, e.g. during parking of the vehicle with the engine in stoppage, or during operation of the engine.

Next, description will be made as to how evaporative fuel is adsorbed into the canister 56 and purged therefrom in the evaporative emission control system according to the second embodiment constructed as above. First during parking of a vehicle in which the engine 1 is installed, with the engine in stoppage, or during operation of the engine, no driving signal from the ECU, not shown is supplied to an electromagnetic valve 34 arranged across the second charging passage 33 to keep the same closed. Evaporative fuel generated in the fuel tank 23 forcibly opens the two-way valve 52 arranged across the first charging passage 27 to be adsorbed by the activated carbon adsorbent 64*a* within the first activated carbon chamber 58 through the inlet port 27*a*. FIG. 6 shows how evaporative fuel generated in the fuel tank 23 flows on an ordinary occasion such as during parking of the vehicle with the engine in stoppage, or during operation of the engine. As shown in the figure, evaporative fuel introduced into the first activated carbon chamber 58 is adsorbed by the adsorbent 64*a*, and then an overflow of evaporative fuel from the chamber 58 is guided through a gap defined between a lower end of the partition 55 and an inner surface of the canister casing 56*a* into the second activated carbon chamber 59 where it is adsorbed by the activated carbon adsorbent 64*b*. An overflow of evaporative fuel is further guided from the second activated carbon chamber 59 and then through the communication passage 71 into the third activated carbon chamber 60 to be adsorbed by the activated carbon adsorbent 64*c*. Since on this occasion the magnetic valve 34 is kept closed as mentioned before, there occurs no backflow of evaporative fuel from the canister 56 to the fuel tank 23 through the second charging passage 33. Further, on this occasion the one-way valve 28*b* remains closed to close the second air-inlet passage 28*a*, so that there positively occurs a serial flow of evaporative fuel through the canister 56. Thus, evaporative fuel flows serially along a generally S-shaped path on an ordinary occasion, the substantial size ratio L/D of the canister 56 can be increased, whereby it is prevented that evaporative fuel passes through the canister 56 without being adsorbed thereby.

Figure 7:
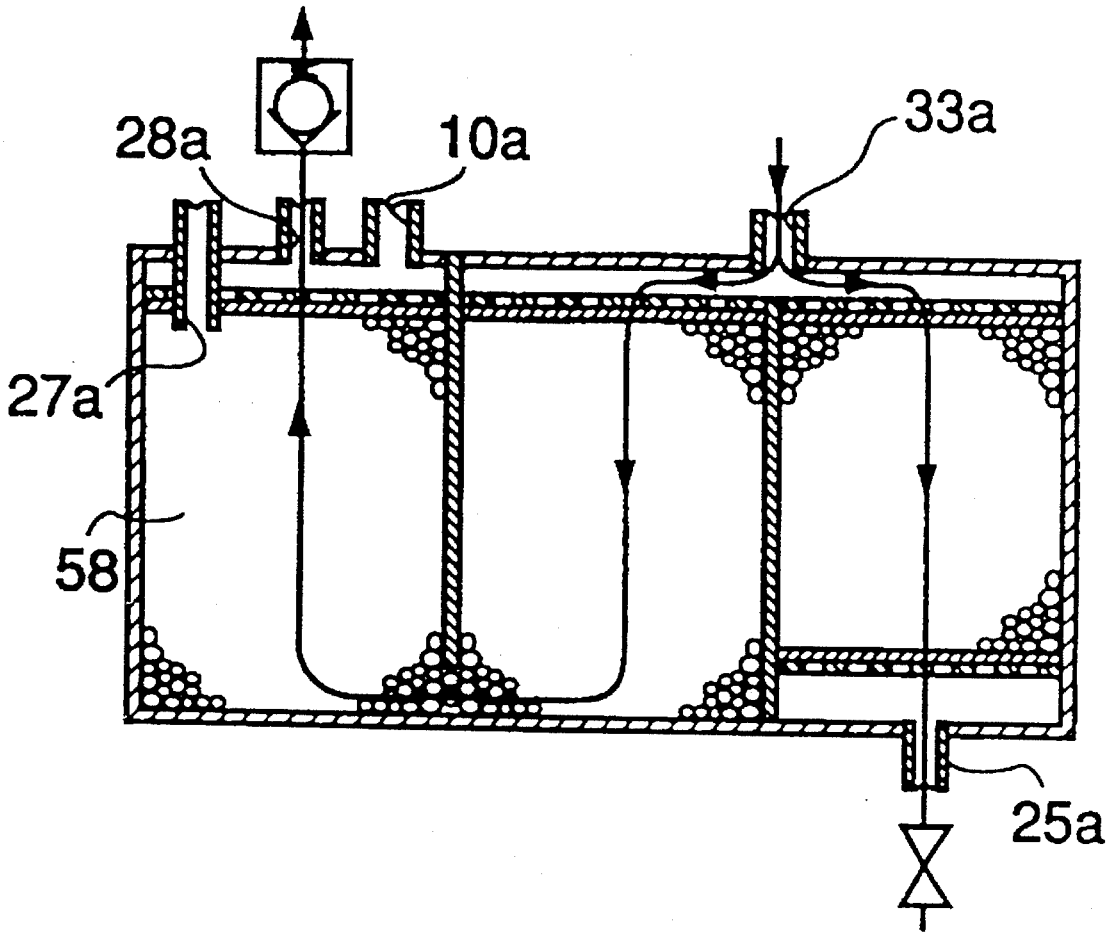
FIG. 7 is a similar view to FIG. 6, useful in explaining how there occurs in the canister a flow of evaporative fuel generated in the fuel tank during refueling.

Next, how evaporative fuel generated in the fuel tank at refueling flows will be described with reference to FIG. 7. At refueling, the electromagnetic valve 34 is opened by a driving signal from the ECU. Then, evaporative fuel generated in large quantities in the fuel tank 23 at refueling is guided at a high flow rate through the second charging passage 33 for use at refueling with an end thereof opening into the fuel tank 23 in the vicinity of the filler cap 22, to the evaporative-fuel introducing port 33*a* at the top of the canister 56, opening into the communication passage 71 connecting between the second and third activated carbon chambers 59, 60, wherefrom it is bifurcated into two flows, one of which enters the second activated 30 carbon chamber 59, and then flows into the first activated carbon chamber 58, and the other flow enters the third activated carbon chamber 60. Flows of evaporative fuel thus entering the chambers 58–60 are adsorbed by the respective activated carbon adsorbents 64*a*, 64*b*, 64*c*. Overflows of evaporative fuel rush toward the respective air-inlet ports 28*a*, 25*a* to be discharged therethrough. On this occasion, increased pressure within the first activated carbon chamber 64*a* due to vigorously flowing evaporative fuel forces the one-way valve 28*b* to open so that the two flows of evaporative fuel are formed in the canister 56. Thus, at refueling there occur two flows of evaporative fuel running parallel with each other such that the substantial size ratio L/D of the canister 56 can be reduced to thereby decrease the flow resistance and hence prevent increased pressure within the fuel tank 23 which impedes smooth refueling.

Figure 8:
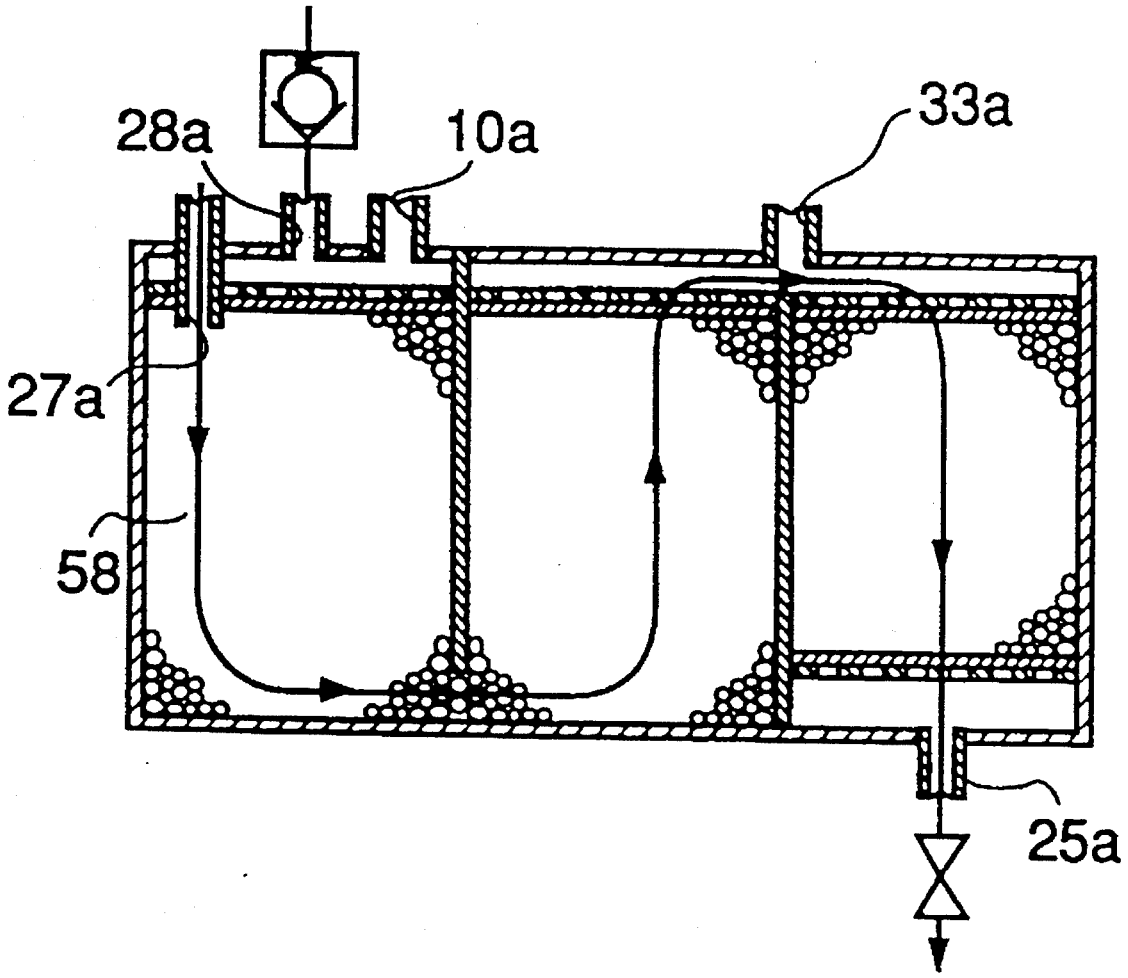
FIG. 8 is a similar view to FIG. 6, useful in explaining how there occurs a flow of evaporative fuel in the canister during purging.

Next, how evaporative fuel is desorbed from the canister 56 and purged into the engine will be described. FIG. 8 shows a flow of evaporative fuel occurring in the canister during purging from the canister 56. To start purging, a driving signal from the ECU is supplied to the purge control valve 36 arranged across the purging passage to open the valve. Purging of evaporative fuel is carried out when the engine 1 is in a predetermined operating condition, as mentioned before. When the engine 1 is in such a predetermined operating condition, there is developed vacuum in the intake pipe 2, which is transmitted through the purging passage 10 with the purge control valve 36 being open, into the first activated carbon chamber 58 within the canister 56, and then into the second activated carbon chamber 59 through the gap between the lower end of the partition 55 and the canister casing 56*a*. Then, vacuum is further transmitted through the communication passage 71 into the third activated carbon chamber 60. Consequently, fresh air is introduced from the outside into the third activated carbon chamber 60 through the first air-inlet passage 25 and the air-inlet port 25*a*, whereby evaporative fuel is desorbed from the adsorbent 64*c* due to the flowing-in air, and a mixture of the desorbed evaporative fuel and the air flows through the communication passage 71 into the second activated carbon chamber 59. Then, also evaporative fuel adsorbed by the adsorbent 64*b* in the second activated carbon chamber 59 is desorbed from the latter, and the resulting mixture of evaporative fuel and air is guided through the gap between the lower end of the partition 55 and the canister casing 56*a* into the first activated carbon chamber 58 where also evaporative fuel adsorbed by the adsorbent 64*a* in the first activated carbon chamber 58 is desorbed from the latter, and the resulting mixture of evaporative fuel and air is guided through the purging passage 10 into the intake pipe 2 to be drawn into the engine 1. In this way, evaporative fuel adsorbed by portions of the adsorbents closer to the air-inlet port 25*a*, and one adsorbed by portions of the adsorbents remote from the port 25*a* are successively supplied into the engine 1 in that order.

As described above, according to the present embodiment, both on ordinary occasions and at refueling, evaporative fuel generated in the fuel tank 23 is adsorbed by the activated carbon adsorbents 64*a*, 64*b*, 64*c* in the first to third activated carbon chambers 58, 59, 60 of the canister 56. As a result, the utilization factor of the adsorbents 64*a*, 64*b*, 64*c* can be increased, similarly to the first embodiment. Therefore, as compared with the conventional arrangement wherein activated carbon adsorbents are accommodated in separate canisters for operation, respectively, at refueling and on ordinary occasions, the amount of activated carbon to be used can be curtailed. Further, according to the embodiment as well, the single purging passage 10 is provided, which simplifies the construction, as compared with the conventional arrangement wherein two or more purging passages are provided. Still further, on an ordinary occasion the activated carbon adsorbents 64*a*, 64*b*, 64*c* are substantially arranged in series for a flow of evaporative fuel in the canister 56 to be adsorbed thereby, whereas at refueling they are substantially arranged in parallel with each other for a flow of evaporative fuel in the canister 56 to be adsorbed thereby, whereby passing of evaporative fuel through the canister 56 without being adsorbed therein can be prevented and also refueling can be carried out in a smooth manner.

Although in the above described embodiments, the activated carbon chambers of the canister accommodate almost the same kind of activated carbon and in almost the same amount, the activated carbon chambers may accommodate different kinds of activated carbons and/or in different amounts from each other. For example, the first activated carbon chamber may be designed larger in size or volume than the second activated carbon chamber so that the latter accommodates a larger amount of activated carbon than the latter. Besides, the activated carbon chambers may accommodate activated carbons which are different in adsorption characteristics from each other. For example, they may accommodate activated carbons which have different properties, e.g. different adsorption characteristics, depending upon evaporative fuel components required to be adsorbed. More specifically, for example, an activated carbon chamber into which evaporative fuel first flows, e.g. the first activated carbon chamber, may accommodate an activated carbon which adsorbs well evaporative fuel components having relatively high boiling points, while the second activated carbon chamber may accommodate an activated carbon which adsorbs well evaporative fuel components having relatively low boiling points.

Figure 9:
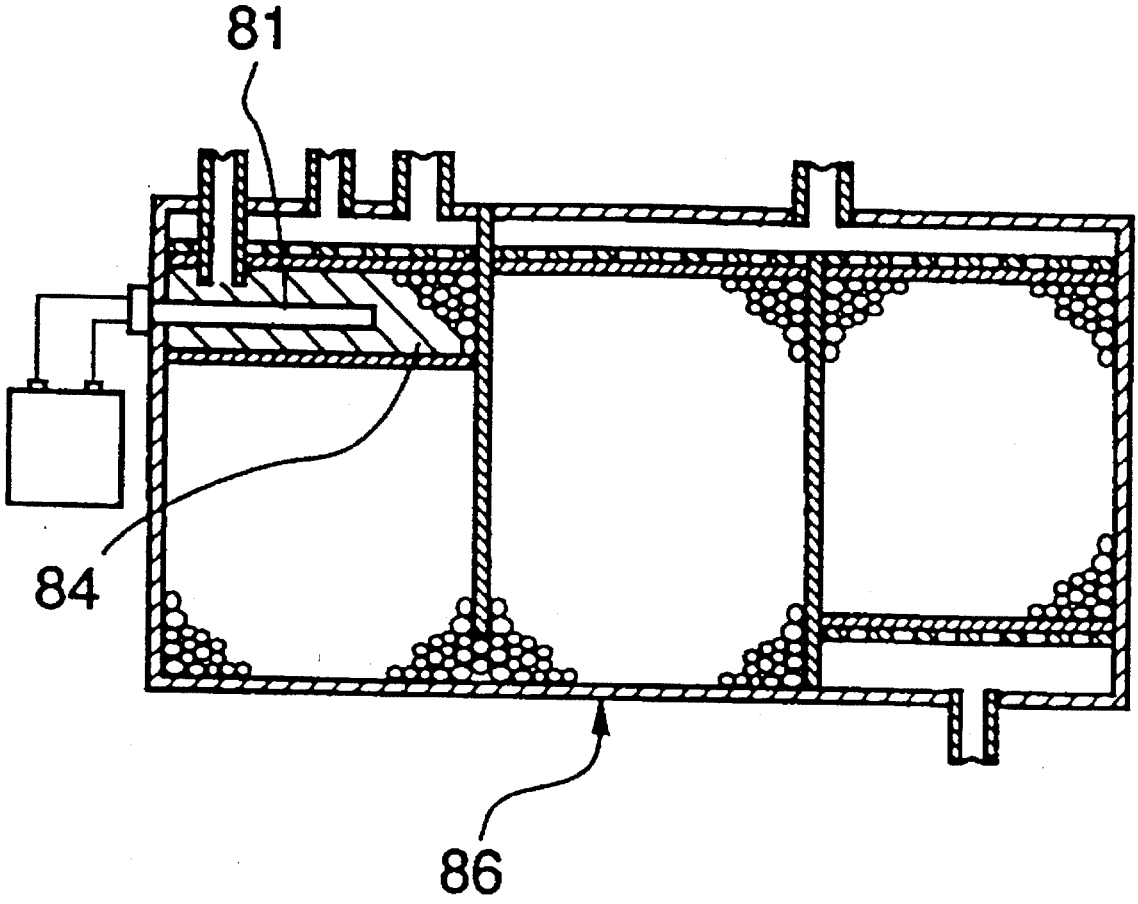
FIG. 9 is a sectional view of a canister according to a variation of the invention, which is provided with a heater.

The activated carbon chamber to which the purging passage is connected, i.e. the first activated carbon chamber, may be provided with a heater for heating activated carbon on a side thereof closer to the purging passage. For example, FIG. 9 shows the interior construction of a canister according to a variation of the invention, in which a heater 81 is provided on a side thereof closer to the purging passage. In the figure, the hatched area in the left activated carbon chamber indicates an area where evaporative fuel is likely to remain adsorbed in an activated carbon adsorbent 84 without being drawn into the engine 1 during purging. By heating evaporative fuel adsorbed in the activated carbon adsorbent 84 in the area by the heater 81 during purging, the remaining evaporative fuel can be vaporized and purged, whereby the purging efficiency is enhanced and deterioration of the canister is prevented.

What is claimed is:

1. In an evaporative emission control system for an internal combustion engine having an intake passage, and a fuel tank, the system including a canister for adsorbing evaporative fuel generated in said fuel tank, a first introducing passage for introducing said evaporative fuel generated in said fuel tank into said canister on an occasion other than at refueling, a purging passage for purging said evaporative fuel adsorbed in said canister into said intake passage of said engine, and a first air-inlet passage connected to said canister and communicating with the atmosphere, the improvement comprising:

a first adsorbent chamber formed in said canister and accommodating an adsorbent, said first introducing passage and said purging passage being connected to said first adsorbent chamber;

a second adsorbent chamber formed in said canister and accommodating an adsorbent, said first air-inlet passage being connected to said second adsorbent chamber;

a communication passage formed in said canister and communicating between said first adsorbent chamber and said second adsorbent chamber;

a second introducing passage connected to said first and second adsorbent chambers, for introducing said evaporative fuel generated in said fuel tank into said canister at refueling;

a second air-inlet passage connected to said first adsorbent chamber and communicating with the atmosphere; and valve means arranged across said second introducing passage, for opening the same at refueling,

2. An evaporative emission control system as claimed in claim 1, wherein said adsorbent accommodated in said first adsorbent chamber and said adsorbent accommodated in said second adsorbent chamber are of substantially the same kind.

3. An evaporative emission control system as claimed in claim 1, wherein said adsorbent accommodated in said first adsorbent chamber and said adsorbent accommodated in said second adsorbent chamber have different adsorption characteristics from each other.

4. An evaporative emission control system as claimed in claim 1, further including heater means for heating said adsorbent accommodated in said first adsorbent chamber.

5. An evaporative emission control system as claimed in claim 1, wherein said first and second air-inlet passages have ends thereof connected, respectively, to said second and first adsorbent chambers at one side of said canister, said communication passage being arranged at another side of said canister opposite said one side, said second introducing passage having an end thereof opening into said communication passage.

6. An evaporative emission control system as claimed in claim 1, including second valve means arranged across said second air-inlet passage, for opening the same at refueling.

7. In an evaporative emission control system for an internal combustion engine having an intake passage, and a fuel tank, the system including a canister for adsorbing evaporative fuel generated in said fuel tank, a first introducing passage for introducing said evaporative fuel generated in said fuel tank into said canister on an occasion other than at refueling, a purging passage for purging said evaporative fuel adsorbed in said canister into said intake passage of said engine, and a first air-inlet passage connected to said canister and communicating with the atmosphere, the improvement comprising:

a first adsorbent chamber formed in said canister and accommodating an adsorbent, said first introducing passage and said purging passage being connected to said first adsorbent chamber;

a second adsorbent chamber formed in said canister and accommodating an adsorbent, said first air-inlet passage being connected to said second adsorbent chamber;

a third adsorbent chamber formed in said canister and accommodating an adsorbent, said third adsorbent chamber being interposed between said first adsorbent chamber and said second adsorbent chamber;

a first communication passage formed in said canister and communicating between said second adsorbent chamber and said third adsorbent chamber;

a second communication passage formed in said canister and communicating between said first adsorbent chamber and said third adsorbent chamber;

a second introducing passage connected to said second and third adsorbent chambers, for introducing said evaporative fuel generated in said fuel tank into said canister at refueling;

a second air-inlet passage connected to said first adsorbent chamber and communicating with the atmosphere; and valve means arranged across said second introducing passage for opening the same at refueling.

8. An evaporative emission control system as claimed in claim 7, wherein said adsorbent accommodated in said first adsorbent chamber, said adsorbent accommodated in said second adsorbent chamber, and said adsorbent accommodated in said third adsorbent chamber are of substantially the same kind.

9. An evaporative emission control system as claimed in claim 7, wherein said adsorbent accommodated in said first adsorbent chamber, said adsorbent accommodated in said second adsorbent chamber, and said adsorbent accommodated in said third adsorbent chamber have different adsorption characteristics from each other.

10. An evaporative emission control system as claimed in claim 7, further including heater means for heating said adsorbent accommodated in said first adsorbent chamber.

11. An evaporative emission control system as claimed in claim 7, wherein said first air-inlet passage has an end thereof connected to said second adsorbent chamber at one side of said canister, said second air-inlet chamber being connected to said first adsorbent chamber at another side of said canister opposite said one side, said first communication passage being arranged at said another side of said canister, said second communication passage being arranged at said one size of said canister, said second introducing passage having an end thereof opening into said first communication passage.

12. An evaporative emission control system as claimed in claim 7, including second valve means arranged across said second air-inlet passage, for opening the same at refueling.

* * * * *